US007192318B2

(12) United States Patent
Hotea et al.

(10) Patent No.: US 7,192,318 B2
(45) Date of Patent: Mar. 20, 2007

(54) CONTACT ELEMENT WITH SPRING TONGUE

(75) Inventors: Gheorghe Hotea, Griesheim (DE); Hannes Jahn Wendling, Langen (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/701,134

(22) Filed: Nov. 4, 2003

(65) Prior Publication Data

US 2004/0164471 A1 Aug. 26, 2004

(30) Foreign Application Priority Data

Nov. 15, 2002 (EP) ..... 02025436

(51) Int. Cl.
*H01R 13/434* (2006.01)

(52) U.S. Cl. ..... 439/745; 439/397

(58) Field of Classification Search ..... 267/36.1, 267/158–160; 439/397–401
See application file for complete search history.

(56) References Cited

U.S. PATENT DOCUMENTS 4,385,794 A * 5/1983 Lucius ..... 439/399
5,266,056 A * 11/1993 Baderschneider et al. .. 439/745
5,624,283 A * 4/1997 Hotea ..... 439/751
5,879,181 A * 3/1999 Okabe ..... 439/397
5,928,025 A * 7/1999 Abe ..... 439/397
5,951,336 A * 9/1999 Seko et al. ..... 439/745
5,980,300 A * 11/1999 Okabe ..... 439/397
6,165,026 A * 12/2000 Sugie et al. ..... 439/748
6,402,571 B1 * 6/2002 Muller et al. ..... 439/745

FOREIGN PATENT DOCUMENTS

EP 0 547 396 B1 8/1996
EP 0 821 438 A1 1/1998

* cited by examiner

*Primary Examiner*—Christopher Schwartz
(74) *Attorney, Agent, or Firm*—Barley Snyder LLC

(57) ABSTRACT

A contact element has a contact body. A contact arrangement is attached to the contact body. The contact arrangement has a spring tongue. The spring tongue has a free end with a locking face for securing the contact element in a contact housing. The locking face is movable between a locked position and an assembly position. The spring tongue has first and second retention tongues. The first retention tongue extends laterally to a longitudinal direction of the spring tongue and engages an opening in the contact body when the locking face is in the locked position. The second retention tongue extends perpendicular to the spring tongue for engagement with the contact housing when the locking face is in the locked position.

20 Claims, 3 Drawing Sheets

CONTACT ELEMENT WITH SPRING TONGUE

FIELD OF THE INVENTION

The invention relates to a contact element and, more particularly, to a contact element having a spring tongue with a locking face for securing the contact element in a contact housing.

BACKGROUND OF THE INVENTION

EP 0 821 438 A1 discloses a contact element comprising a spring tongue with a locking face. The spring tongue is constructed in the form of a rectangular plate and is connected to a contact body via a bending line. When the contact element is inserted into a contact housing, the spring tongue pivots upwards and comes to rest on a retention face of the contact housing. The spring tongue thereby prevents unintentional removal of the contact element from the contact housing.

EP 0 547 396 B1 further discloses a contact element comprising a spring tongue substantially constructed in the form of rectangular plate that is connected to a contact body via a bending line. The spring tongue has impressions. When the contact element is inserted into a contact housing, the spring tongue is braced against a bearing face of the contact housing. The impressions prevent the spring tongue from collapsing. The spring tongue thereby prevents unintentional withdrawal of the contact element from the contact housing.

SUMMARY OF THE INVENTION

An object of the invention, therefore, is to provide a contact element with a spring tongue that better protects against unintentional withdrawal of the contact element from a contact housing.

This and other objects are achieved by a contact element having a contact body and a contact arrangement attached to the contact body. The contact arrangement has a spring tongue. The spring tongue has a free end with a locking face for securing the contact element in a contact housing. The locking face is movable along a bending path between a locked position and an assembly position. A retention element extends from the spring tongue and engages the contact body to secure the spring contact from bending outside of the bending path when the locking face is in the locked position.

This and other objects are further achieved by a contact element having a contact body and a contact arrangement attached to the contact body. The contact arrangement has a spring tongue. The spring tongue has a free end with a locking face for securing the contact element in a contact housing. The locking face is movable between a locked position and an assembly position. The spring tongue has first and second retention tongues. The first retention tongue extends laterally to a longitudinal direction of the spring tongue and engages an opening in the contact body when the locking face is in the locked position. The second retention tongue extends perpendicular to the spring tongue for engagement with the contact housing when the locking face is in the locked position.

DETAILED DESCRIPTION OF THE INVENTION

Figure 1:
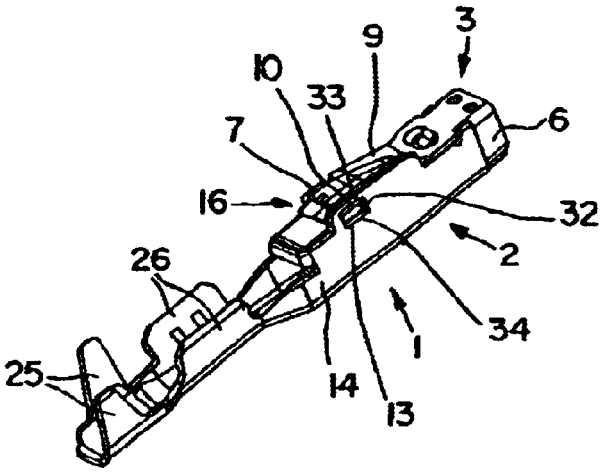
FIG. 1 is a perspective view of a contact element.
Figure 7:
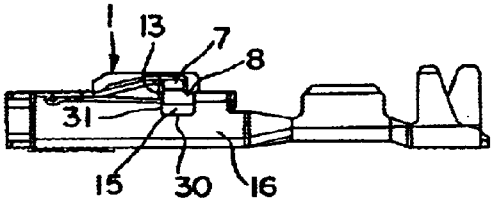
FIG. 7 is a side view of the contact element of FIG. 1.
Figure 8:
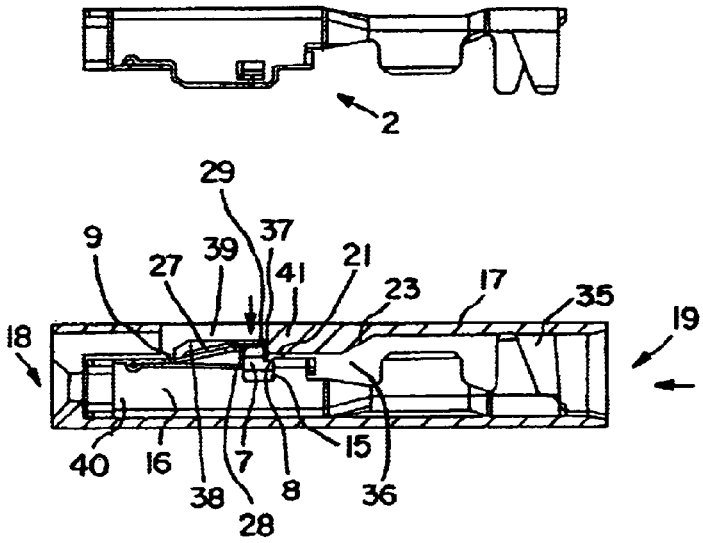
FIG. 8 is an exploded sectional view of the contact element in a contact housing.

FIG. 1 shows a contact element 1. The contact element 1 comprises a contact body 2 and a contact arrangement 3. The contact body 2 and the contact arrangement 3 are produced from a conductive metal material. As shown in FIG. 1, the contact body 2 includes two side walls 14, 16, first fastening tongues 25, and second fastening tongues 26. The first side wall 14 has an opening 13. The opening 13 has a right-hand side edge 32, an upper side edge 33, and a lower side edge 34. As best shown in FIGS. 7 and 8, the second side wall 16 has a recess 15. The recess 15 has a lower edge 30 and a left-hand side edge 31. The first fastening tongues 25 are used to clamp a conductor insulation of an electrical cable (not shown). The second fastening tongues 26 are used to clamp and electrically contact electric conductors (not shown) of the electrical cable (not shown). An electrically conductive connection between the electrical cable (not shown), the contact body 2 and the contact arrangement 3 is thus produced.

FIGS. 2 through 5 show the contact arrangement 3. The contact arrangement 3 is inserted between the two side walls 14, 16 of the contact body 3. The contact arrangement 3 and the contact body 2 are rigidly connected to one another via weld points. The contact arrangement 3 includes an opening frame 6 that adjoins end faces of the contact body 2. The opening frame 6 forms an insertion opening for a pluggable contact to be electrically connected to the contact element 1.

Figure 2:
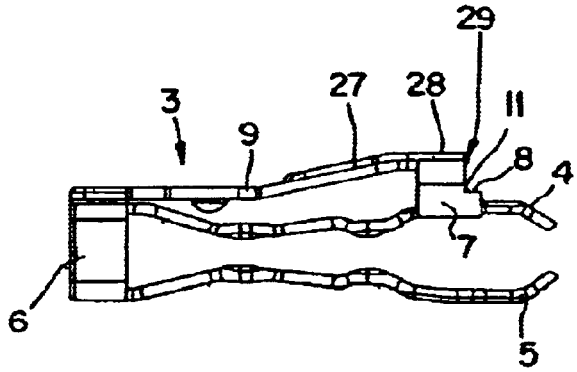
FIG. 2 is a side view of a contact arrangement.
Figure 6:
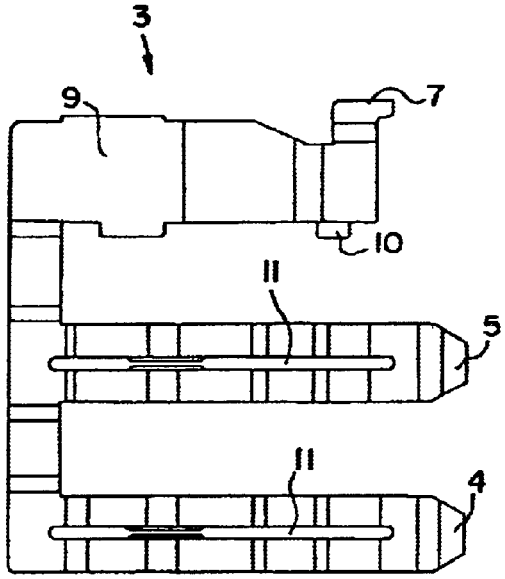
FIG. 6 is a plan view of a punched part of the contact arrangement.

As best shown in FIG. 2, two end regions of first and second spring contacts 4, 5 are fastened to opposing sides of the opening frame 6. The first and second spring contacts 4, 5 extend beyond an end of a spring tongue 9 that is described later. The first and second spring contacts 4, 5 are undulating and symmetrically arranged with respect to a center line. As best shown in FIG. 6, the first and second spring contacts 4, 5 comprise centrally arranged slots 11. The first and second spring contacts 4, 5 contact the pluggable contact on both sides when the pluggable contact is inserted through the opening frame 6 into the contact element 1. The slots 11 improve the contact between the pluggable contact and the contact arrangement 3.

Figure 4:
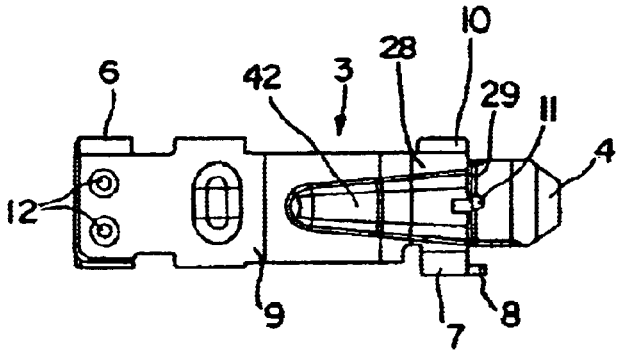
FIG. 4 is a plan view of the contact arrangement.
Figure 5:
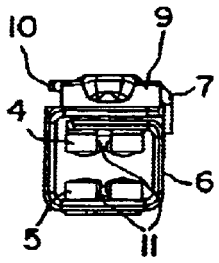
FIG. 5 is a back view of the contact arrangement.

As best shown in FIG. 4, the spring tongue 9 is fastened to a first end region at an upper side of the opening frame 6. The spring tongue 9 is connected via fastening points 12 to the opening frame 6 of the first spring contact 4 so that an upper side of the contact element 1 is covered by the spring tongue 9. The fastening points 12 are, for example, weld points. Proceeding from the first end region, the spring tongue 9 is arranged virtually parallel to the opening frame 6. As best shown in FIG. 2, at a predetermined distance from the opening frame 6, the spring tongue 9 bends upwards and merges into a sliding section 27. The sliding section 27 merges into a second end piece 28 arranged approximately parallel to the opening frame 6. A locking face 29 is constructed on the second end piece 28 at a front end opposing the opening frame 6. As best shown in FIG. 4, the spring tongue 9 has indents 42 for increasing the rigidity of the spring tongue 9.

As best shown in FIG. 4, the spring tongue 9 is fastened to a first end region at an upper side of the opening frame 6. The spring tongue 9 is connected via fastening points 12 to the opening face 6 of the first spring contact 4 so that an upper side of the contact element 1 is covered by the spring tongue 9. The fastening points 12 are, for example, weld points. Proceeding from the first end region, the spring tongue 9 is arranged virtually parallel to the opening frame 6. As best shown in FIG. 2, at a predetermined distance from the opening frame 6, the spring tongue 9 bends upwards and merges into a sliding section 27. The sliding section 27 merges into a second end piece 28 arranged approximately parallel to the opening frame 6. A locking face 29 is constructed on the second end piece 28 at a front end opposing the opening frame 6. As best shown in FIG. 4, the spring tongue 9 has indents 42 for increasing the rigidity of the spring tongue 9.

Figure 3:
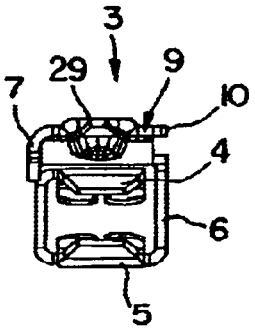
FIG. 3 is a front view of the contact arrangement.

First and second retention tongues 10, 7 are formed on opposing longitudinal sides of the second end piece 28. As best shown in FIG. 3, the first retention tongue 10 is integrally formed with the spring tongue 9 and is constructed at the same height as the second end piece 28. The second retention tongue 7 is constructed on the spring tongue 9 opposite the first retention tongue 10. The second retention tongue 7 is guided laterally out of the second end piece 28 and downward about a 90 degree bend in a direction of the first spring contact 4. As best shown in FIGS. 2 and 3, the second retention tongue 7 has a laterally extending step 8 at a predetermined spacing from the second end piece 28. The step 8 widens the second retention tongue 7 and projects beyond the second end piece 28 in a longitudinal direction of the spring tongue 9 beyond the locking face 29.

FIG. 6 shows a punched part of the contact arrangement 3 with the first and second spring contacts 4, 5 and the spring tongue 9 connected therewith. The slot 11 of the first and second spring contacts 4, 5 does not extend through the front tip of the first or second spring contacts 4, 5. The contact arrangement 3 is obtained from the punched part shown in FIG. 6 by bending and pressing the punched part into the corresponding shape.

Figure 9:
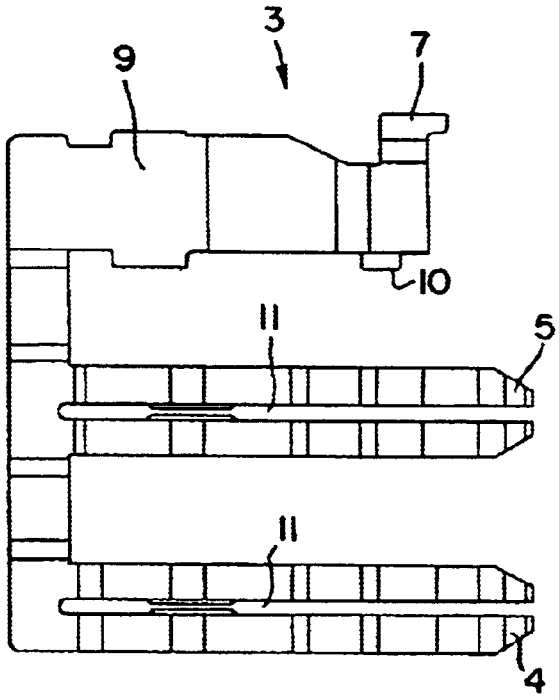
FIG. 9 is a plan view of another embodiment of a punched part of a contact arrangement.

FIG. 9 shows another embodiment of a punched part of the contact arrangement 3, which is constructed in one piece, and includes the first and second spring contacts 4, 5 and the spring tongue 9. The first and second spring contacts 4, 5 have a slot 11 in this embodiment that extends through the front tip of the first and second spring contacts 4, 5. The first and second spring contacts 4, 5, therefore, are constructed in the form of two spring arms arranged in parallel. The contact arrangement 3 is obtained from the punched part shown in FIG. 9 by bending and stamping the punched part into the corresponding shape.

FIG. 8 shows a contact housing 17 into which the contact element 1 is inserted. The contact housing 17 has a contact opening 18 at a left-hand side. The contact opening 18 is used for insertion of the pluggable contact into the opening frame 6 for contacting the pluggable contact with the spring contacts 4, 5. Opposite the contact opening 18, the contact housing 17 has an insertion opening 19. The contact housing 17 has a first receiving space 35 adjoining the insertion opening 19 and merging into an intermediate space 36 via a tapering bevel 23. The tapering bevel 23 projects from an upper side of the contact housing 17 into the first receiving space 35 and includes a retention block 41 with a lower bearing face 21. The intermediate space 36 has a lower height than the first receiving space 35. The intermediate space 36 widens via a step 37 to a second receiving space 38. The second receiving space 38 has a greater height than the intermediate space 36. An upper side of the contact housing 17 has an assembly opening 39 arranged above the second receiving space 38. The second receiving space 38 tapers via a step to a contact space 40. The contact space 40 is connected to the contact opening 18 and has substantially the same cross-section as the contact element 1.

Assembly and operation of the contact element 1 will now be described in greater detail. The electrical cable (not shown) is inserted into the contact body 2 and clamped by the first fastening tongues 25 and the second fastening tongues 26 to establish an electrically conductive connection between the electrical cable, the contact body 2 and the contact arrangement 3. The opening frame 6 of the contact element 1 is inserted into the insertion opening 19 of the contact housing 17. The cross-section of the first receiving space 35 is dimensioned such that the contact element 1 may be inserted into the receiving space 35 up to the sliding portion 27 of the spring tongue. As the contact element 1 is further inserted into the insertion opening 19, the sliding portion 27 of the spring tongue 9 slides along the tapering bevel 23. The tapering bevel 23 pushes the spring tongue 9 downward in a direction of the contact body 2. The height of the opening 13 in the first side wall 14 is dimensioned such that the spring tongue 9 may be pressed far enough under the retention block 41 that the contact element 1 may be pushed through the intermediate region 36 and up to a stop at the end of the contact space 40. When the contact element 2 is fully inserted, the sliding portion 27 and the second end piece 28 of the spring tongue 9 are arranged in the second receiving space 38. When the locking face 29 of the spring tongue 9 reaches the second receiving space 38, the spring tongue 9 springs upward. An end face of the locking face 29 comes to rest on the second step 37, and the step 8 of the second retention tongue 7 comes to rest on the lower bearing face 21 of the retention block 41. The spring tongue 9 thereby locks the contacting element in the contact housing 17.

The recess 15 of the second side wall 16 is designed such that the second retention tongue 7 can resiliently deflect into the recess 15 when the spring tongue 9 is depressed. The second retention tongue 7, therefore, may be arranged above the second side wall 16 without interfering with the movement of the spring tongue 9. The lower edge 30 of the recess 15 limits the maximum deflection of the spring tongue 9 downward in the direction of the contact body 2 by stopping the second retention tongue 7. The left-hand side edge 31 is associated with the left-hand side edge of the second retention tongue 7. In the locked position of the spring tongue 9 the second retention tongue 7 preferably already engages partially in the recess 15. In this position, the left-hand side edge 31 of the recess 15 limits a movement of the spring tongue 9 in the longitudinal direction. Therefore, the spring tongue 9 is secured by the left-hand side edge 31 of the recess 15 against a force acting on the locking face 29 and displacement or bending of the spring tongue 9 is avoided up to an increased force.

The first retention tongue 10 engages the opening 13 in the region of the spring tongue 9. The first retention tongue 10 preferably adjoins the upper edge 33 of the opening 13. As shown in FIG. 1, the right-hand side edge 32 is associated with a back side edge of the first retention tongue 10. As the first retention tongue 10 engages in the opening 13, the spring tongue 9 is secured by the first retention tongue 10 against displacement owing to a force acting on the locking face 29 and is held thereby. The upper side edge 33 of the opening 13 limits a maximum upward deflection of the spring tongue 9. The lower side edge 34 limits the maximum deflection of the spring tongue 9 in a direction of the contact body 2 by stopping the first retention tongue 10. The first retention tongue 10 remains in the opening 13 throughout insertion.

The openings 13, the first retention tongue 10, the recess 15, and the second retention tongue 7 are preferably matched to one another such that, on a fixed maximum deflection of the spring tongue 9 in the direction of the contact body 2, the first retention tongue 10 and the second retention tongue 7 simultaneously come to rest on the lower side edge 34 of the opening 13 and the lower edge 30 on the recess 15. A symmetrical limitation of the deflection of the spring tongue 9 in the direction of the contact body 2, i.e., in the direction of the assembly position, is thereby achieved.

If a tensile force is now exerted on the contact element 1 by a cable rigidly connected by the first and second fastening tongues 25, 26 to the contact element 1, the locking face 29 that is arranged parallel to the step 37 is pressed against the step 37. In this position a force is exerted on the spring tongue 9 in the longitudinal direction on the second end piece 28 of the spring tongue 9. The spring tongue 9 is prevented from bending as a result of this force, because the second end piece 28 is braced by the contact body 2 on both sides. The spring tongue 9 is held in the locked position by the second retention tongue 7 that is supported against the left-hand side edge 31 of the recess 15, and the spring tongue 9 is held in the locked position by the first retention tongue 10 that is braced against the right-hand side edge 32 of the opening 13. In addition, tilting of the contact element 1 with respect to the retention block 41 is prevented, because the position of the spring tongue 9 is adjusted with respect to the retention block 41 by the step 8 that rests on the lower side of the retention block 41. Unintentional withdrawal of the contact element 1 from the insertion opening 19, therefore, is prevented.

To remove the contact element 1 from the contact housing 17, the spring tongue 9 is pressed downward in the direction of the contact body 2, by an assembly tool (not shown) that is inserted into the assembly opening 39. The spring tongue 9 is pressed downward until the upper side of the second end piece 28 is positioned below the bearing face 21 of the retention block 41. The contact element 1 is then withdrawn from the insertion opening 19 by the electrical cable fastened to the contact element 1.

We claim:

1. A contact element, comprising:

a contact body;

a contact arrangement attached to the contact body, the contact arrangement having a spring tongue, the spring tongue having a free end with a locking face for securing the contact element in a contact housing, the locking face being moveable along a bending path between a locked position and an assembly position; and a retention element extending from the spring tongue, the retention element engages the contact body to secure the spring tongue from bending outside of the bending path when the locking face is in the locked position, the retention element having a step that projects in a longitudinal direction of the spring tongue beyond the locking face for engagement with the contact housing when the locking face is in the locked position to prevent tilting of the contact element.

2. The contact element according to claim 1, further comprising a first retention tongue that extends laterally to a longitudinal direction of the spring tongue and engages an opening in the contact body.

3. The contact element according to claim 2, wherein the opening includes a limiting edge for limiting the movement of the first retention tongue.

4. The contact element according to claim 1, wherein the retention element extends perpendicular to the spring tongue.

5. The contact element according to claim 4, wherein the contact body includes a recess that receives the retention element during movement of the locking face between the assembly position and the locked position.

6. The contact element according to claim 5, wherein the recess includes an edge that limits movement of the spring tongue in a direction of the assembly position.

7. The contact element according to claim 4, wherein the retention element engages a recess in the contact body to limit movement of the spring tongue along a longitudinal direction when the locking face is in the assembled position.

8. The contact element according to claim 1, wherein the spring tongue covers an upper side of the contact element.

9. The contact element according to claim 8, wherein the contact arrangement includes first and second spring contacts extending essentially parallel to the spring tongue.

10. The contact element according to claim 9, wherein the contact arrangement is formed from a punched metal plate.

11. The contact element according to claim 9, wherein the first and second spring contacts include slots extending along a center and in a longitudinal direction thereof.

12. A contact element, comprising:

a contact body;

a contact arrangement attached to the contact body, the contact arrangement having a spring tongue, the spring tongue having a free end with a locking face for securing the contact element in a contact housing, the locking face being moveable between a locked position and an assembly position;

a first retention tongue that extends from the spring tongue, the first retention tongue extends laterally to a longitudinal direction of the spring tongue, the first retention tongue engages an opening in the contact body when the locking face is in the locked position, the first retention tongue being positioned at the same height as an end piece of the spring tongue; and a second retention tongue that extends from the spring tongue, the second retention tongue extends perpendicularly below the end piece of the spring tongue and has a step that projects in the longitudinal direction of the spring tongue beyond the locking face, the second retention tongue engages the contact housing when the locking face is in the locked position.

13. The contact element according to claim 12, wherein the opening includes a limiting edge for limiting the movement of the first retention tongue.

14. The contact element according to claim 12, wherein the contact body includes a recess that receives the second retention tongue during movement of the locking face between the assembly position and the locked position.

15. The contact element according to claim 14, wherein the recess includes an edge that limits movement of the spring tongue in a direction of the assembly position.

16. The contact element according to claim 12, wherein the second retention tongue engages a recess in the contact body to limit movement of the spring tongue along a longitudinal direction when the locking face is in the assembled position.

17. The contact element according to claim 12, wherein the spring tongue covers an upper side of the contact element.

18. The contact element according to claim 17, wherein the contact arrangement includes first and second spring contacts extending essentially parallel to the spring tongue.

19. The contact element according to claim 18, wherein the contact arrangement is formed from a punched metal plate.

20. The contact element according to claim 18, wherein the first and second spring contacts include slots extending along a center and in a longitudinal direction thereof.

* * * * *